US006162496A

United States Patent [19]

Blue

[11] Patent Number: 6,162,496

[45] **Date of Patent: *Dec. 19, 2000**

[54] METHOD OF MIXING

[76] Inventor: David Blue, 3575 Gordon Rd., Elkhart, Ind. 46516

[ * ] Notice: This patent is subject to a terminal disclaimer.

[21] Appl. No.: 09/231,691

[22] Filed: Jan. 14, 1999

Related U.S. Application Data

[63] Continuation-in-part of application No. 08/650,871, May 20, 1996, Pat. No. 5,866,201.

[51] Int. Cl.[7] ..... B05D 7/00

[52] U.S. Cl. ..... 427/212; 222/235; 222/240; 222/241; 366/242; 366/296; 427/420; 427/424; 427/425; 427/430.1; 427/444

[58] Field of Search ..... 427/212, 444, 427/420, 430.1, 424, 425; 366/212, 296; 222/235, 240, 241

[56] References Cited

U.S. PATENT DOCUMENTS

| | | | |
|---|---|---|---|
| 3,421,740 | 1/1969 | Behrens | 259/41 |
| 3,734,471 | 5/1973 | Engels | 259/6 |
| 3,856,278 | 12/1974 | Eisenmann | 259/192 |
| 3,968,771 | 7/1976 | Walgenbach et al. | 118/303 |
| 4,014,286 | 3/1977 | De Zurik | 118/2 |
| 4,025,058 | 5/1977 | Mizuguchi | 259/192 |
| 4,067,140 | 1/1978 | Thomas | 47/9 |
| 4,079,696 | 3/1978 | Weber | 118/417 |
| 4,107,787 | 8/1978 | Ocker | 366/75 |
| 4,202,636 | 5/1980 | Vanderveen | 366/319 |
| 4,232,480 | 11/1980 | Videen | 47/9 |
| 4,290,702 | 9/1981 | Klein et al. | 366/77 |
| 4,387,997 | 6/1983 | Klein et al. | 366/79 |
| 4,474,852 | 10/1984 | Craig | 428/403 |
| 4,516,524 | 5/1985 | McClellan et al. | 118/683 |
| 4,586,459 | 5/1986 | Schultz | 118/303 |
| 4,681,457 | 7/1987 | Orimo et al. | 366/84 |
| 4,932,156 | 6/1990 | Underwood | 47/9 |
| 5,105,577 | 4/1992 | Hedges | 47/9 |
| 5,192,587 | 3/1993 | Rondy | 427/212 |
| 5,266,256 | 11/1993 | Jerman et al. | 264/211.24 |
| 5,267,788 | 12/1993 | Rockstedt | 366/85 |
| 5,308,653 | 5/1994 | Rondy | 427/212 |
| 5,354,127 | 10/1994 | Del Zotto et al. | 366/27 |
| 5,358,738 | 10/1994 | Sawka | 427/220 |
| 5,401,534 | 3/1995 | Bourreau et al. | 427/212 |
| 5,562,956 | 10/1996 | White, Jr. | 428/17 |
| 5,866,201 | 2/1999 | Blue | 427/212 |

OTHER PUBLICATIONS

*The Revolutionary Second Harvester, Mulch Coloring System*, by Becker–Underwood, Inc., Marketing brochure, dated Oct. 1996.

*Primary Examiner*—Bernard Pianalto
*Attorney, Agent, or Firm*—Woodard, Emhardt, Naughton Moriarty & McNett

[57] ABSTRACT

A mixing system with a vessel for supplying a liquid and a device for supplying solid pieces to mix with the liquid. The system has an elongate enclosure with a first end opposing a second end. The enclosure defines a chamber in fluid communication with the vessel to receive the liquid. The chamber also has a inlet and an outlet with the inlet being closer to the first end than the outlet. The chamber receives the pieces from the device through the inlet and issues the pieces through the outlet. A motor driven mixing auger positioned in the chamber between the first and second ends rotates a selected direction about a rotational axis to intermix the liquid and pieces. The auger includes a first helical flight between the inlet and the outlet to convey the pieces from the inlet to the outlet when the shaft is rotated the selected direction. The auger also includes a second helical flight between the first flight and the second end to urge the solid pieces in a direction opposite the first flight. The second flight has a length along the rotational axis of the auger shorter than the first flight. In one variation of this system, the liquid may be a colorant and the solid pieces may include wood chips to be intermixed with the liquid to attain a uniform visual appearance.

21 Claims, 8 Drawing Sheets

METHOD OF MIXING

CROSS-REFERENCE TO RELATED APPLICATIONS

The present application is a continuation-in-part of commonly owned U.S. Patent application Ser. No. 08/650,871, filed May 20, 1996, now U.S. Pat. No. 5,866,201.

BACKGROUND OF THE INVENTION

The present invention relates to mixing solid pieces with a liquid, and more particularly, but not exclusively, relates to coating and coloration of landscaping materials.

The problem of landfill crowding has grown steadily. One way to reduce this crowding is to recycle as many materials as possible. One type of material suitable for recycling is wood. Wood may arrive at the landfill from a natural source, such as discarded tree branches, or it may be derived from various discarded products, such as shipping crates and furniture.

One way to recycle wood is to reduce the wood to a number of pieces of generally uniform size with a shredder, chipper, or grinder. Such comminuted wood is often suitable for use as a landscaping mulch. However, the varied types of wood typically obtained from a landfill often result in a non-uniform coloration that significantly changes with age and exposure to the elements. To alleviate this problem, recycled wood pieces are sometimes treated with a colorant to provided a more pleasing appearance. U.S. Pat. No. 5,308,653 to Rondy describes one coloring process.

One problem often encountered with coloring processes is excessive run-off of liquid colorants used to impart a uniform appearance to the wood pieces. This run-off adversely impacts cost effectiveness. To address this problem, there is a need to optimize the coloration process by determining the minimum amount of liquid colorant needed for a given amount of wood. There also remains a need to provide a more cost effective way to uniformly color landscaping material.

Another problem with the coloration process is that mixers used to blend liquid colorant and wood pieces are subject to frequent jamming. Typically, the mixer becomes packed with a mass of wood chips that are stuck together. This mass of chips often prevents discharge of the treated product from the mixer. Equipment down time to unclog the mixer generally increases processing costs and may result in excessive colorant run-off. Thus, there is also a need for a mixing system which resists packing and still economically imparts a uniform color to landscaping materials.

SUMMARY OF THE INVENTION

One form of the present invention is a system with a mixer defining a chamber that has an opening for inserting solid pieces therein. The chamber is in fluid communication with a conduit. Furthermore, the system has a source of a liquid agent and a metering device to selectively provide the agent from the source to the conduit. A water supply is coupled to the conduit to dilute the agent prior to reaching the pieces in the chamber. A controller is operatively coupled to the metering device to provide a delivery signal. The metering device responds to the delivery signal to adjust delivery of the agent to the conduit from a first nonzero rate to a second non-zero rate.

In an alternative form of the present invention, water and a colorant are mixed to produce a colorant liquid mixture during the movement of wood chips within a mixing chamber. Colorant supply to the liquid mixture is metered to control colorant amount or concentration in the mixture. The liquid mixture is put into the chamber to color at least a portion of the chips. The chips are discharged from the chamber. In one variation of this feature, landscaping gravel or rocks may be colored with the mixing process. In another variation, the mixture imparts a clear coating to rocks or another landscaping material to provide a high gloss appearance.

Among other alternative forms of the present invention are a mixing system with a vessel for supplying a liquid and a device for supplying solid pieces to mix with the liquid. The system has an elongated enclosure with a first end opposing a second end. The enclosure defines a chamber in fluid communication with the vessel to receive the liquid. The chamber also has an inlet and an outlet with the inlet being closer to the first end than the outlet. The chamber receives the pieces from the device through the inlet and discharges the pieces through the outlet. A motor driven mixing auger positioned in the chamber between the first and second ends rotates about a rotational axis to intermix the liquid and pieces. The auger includes a first helical flight between the inlet and the outlet to convey the pieces from the inlet to the outlet when the auger is rotated. The auger also includes a second helical flight between the first flight and the second end. The second flight has a length along the rotational axis shorter than the first flight. The second flight may have a rotational direction opposite the first flight and be positioned at least partially over the outlet to reduce clogging. In one variation of this system, the liquid may be a colorant and the solid pieces may include wood chips to be intermixed with the liquid to attain a generally uniform color.

In yet another alternative form, the first and second flights are mounted about an elongated shaft configured to rotate about the rotational axis and a portion of the first flight does not contact the shaft while turning about the rotational axis for at least three revolutions, defining a space therebetween. This structure enhances intermixing of the wood pieces with the liquid.

In still another alternative form, a mixing technique includes moving a number of wood chips through a generally horizontal, elongated passage of a mixer from a top inlet adjacent a first end of the mixer to a bottom outlet adjacent a second end of the mixer. This movement is performed by turning a pair of augers disposed within the passage. The inlet and outlet are spaced apart from one another along a longitudinal axis of the mixer. A liquid colorant and water are mixed to provide a liquid coloring mixture during movement of the wood chips. This mixing is regulated with a controller. The mixture is provided to a spray hood to impart color to the wood chips while moving. The spray hood defines a chamber projecting above the passage and having a plurality of nozzles that deliver the mixture to the chamber under pressure. The chamber intersects the passage to define an area for contacting the wood chips with the mixture. This area is positioned generally opposite the nozzles to extend along the longitudinal axis of the mixture at least about two-thirds of a distance between the inlet and the outlet. Further, this area transversely spans across at least about three-fourths of a top width of the passage occupiable by the wood chips. The wood chips are discharged through the outlet. It has been found that this arrangement facilitates reduction of the amount of water needed to adequately color the wood chips.

In a further alternative form, a mixing technique includes moving a number of wood chips within a mixing chamber and blending water and a colorant in a static mixer while the wood chips are moving to produce a generally homogenous liquid colorant mixture for supply to the chamber. The mixer includes a cavity containing one or more internal baffles oriented to mix the water and colorant. The colorant is metered to the mixture with a variable rate pump responsive to a controller while maintaining a generally constant flow rate of the water to the mixture with a flow rate regulator. A coloring property of the wood chips is determined and concentration of the colorant in the mixture is adjusted from a first non-zero amount to a second non-zero amount in accordance with the coloring property. This adjustment includes changing delivery rate of the colorant to the mixture with the controller. At least a portion of the wood chips are colored in the chamber with the mixture. The wood chips are then discharged from the chamber.

Accordingly, it is one object of the present invention to provide a system that dispenses a liquid to a mixer for blending with solid pieces therein.

It is another object of the present invention to optimize the mixing of a concentrated liquid agent with water to create a liquid mixture for supply to the chamber of a mixer for blending with solid pieces. The agent may include a colorant or clear coat material and the solid pieces may comprise landscaping material such as wood chips or rocks.

It is still another object to color wood chips to provide a mulch. Preferably, the coloration technique reduces the amount of water needed to apply a water-based colorant mixture to the chips and the amount of colorant mixture run-off.

An additional object of the present invention is to provide a mixer which resists packing of solid pieces being blended with a liquid therein.

Further objects, features, aspects, benefits, and advantages of the present invention shall be apparent from the detailed drawings and descriptions provided herein.

DESCRIPTION OF THE PREFERRED EMBODIMENTS

Figure 1:
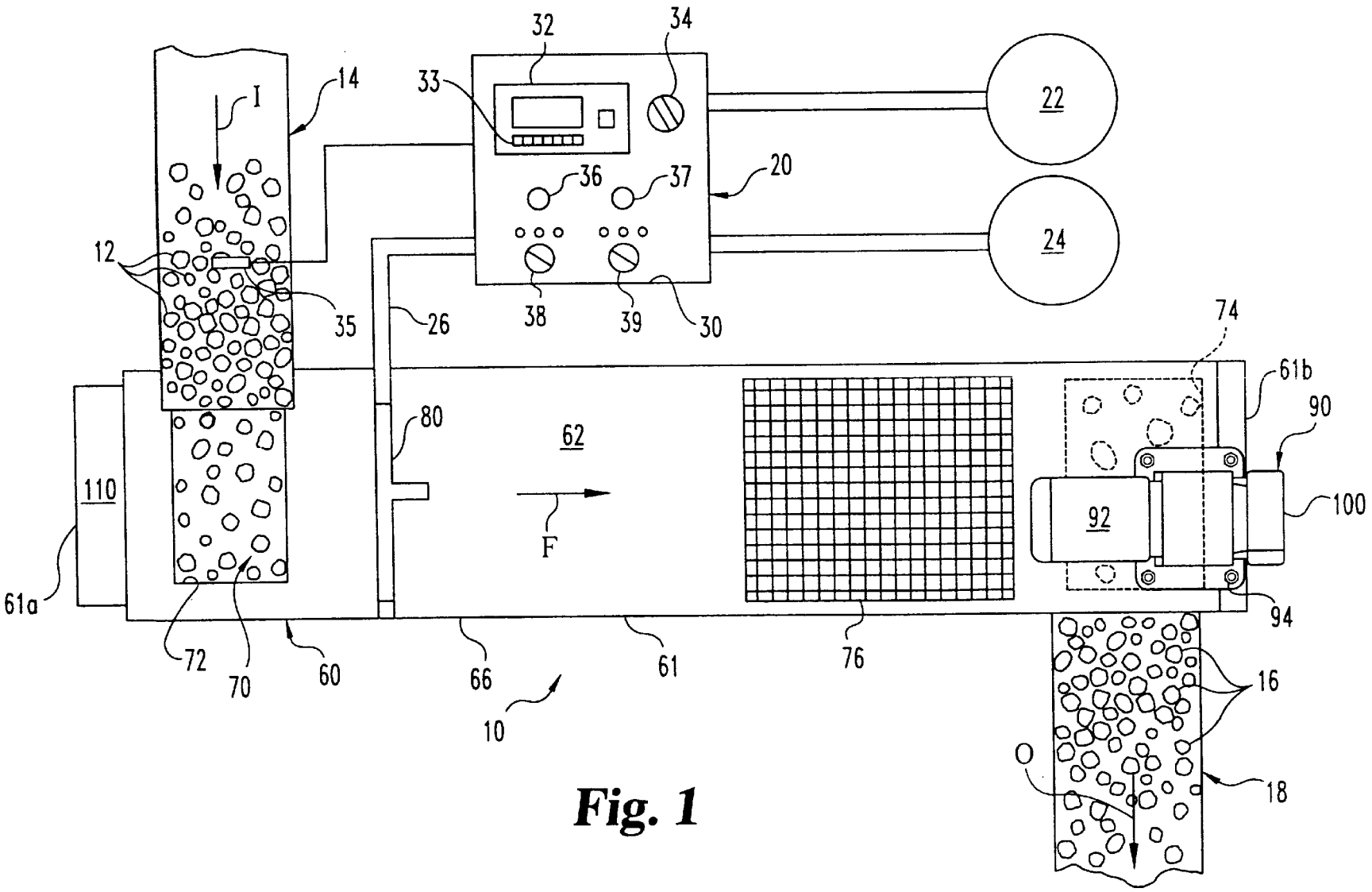
FIG. 1 is a schematic top view of a colorant mixing system of one preferred embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications of the described embodiments, and any further applications of the principles of the invention as described herein are contemplated as would normally occur to one skilled in the art to which the invention relates.

FIG. 1 depicts a colorant mixing system 10 of the present invention. In system 10, a number of wood chips 12 are transported by conveyer 14 in a direction along arrow I to mixer 60. The chips 12 enter chamber 70 of mixer 60 through inlet 72 and are processed therein. This processing includes mixing with a water-based colorant from dispensing system 20. Processed wood chips 16 exit through outlet 74 of mixer 60 and are carried away by conveyer 18 in a direction along arrow 0.

Dispensing system 20 combines concentrated colorant from source 22 with water from water supply 24 to provide a liquid mixture for delivery to chamber 70 via conduit 26. Preferably, source 22 includes a vessel holding an ample supply of the concentrated colorant. Source 22 may include a plurality of vessels or a colorant dispensing sub-system. Water supply 24 is preferably a well water source or city water source of a conventional type.

Dispensing system 20 includes control panel 30 with a display 32 indicating the rate colorant is being delivered for mixing. This rate may be continuously adjusted by an operator with rotary control 34. Control panel 30 also includes a control key pad 33, a master start switch 36, and a master stop switch 37. Switches 36, 37 start and stop delivery system 20, respectively. In addition, control panel 30 has switch 38 corresponding to water supply 24 and switch 39 corresponding to colorant source 22. Each switch 38, 39 has three positions: on, off, and automatic (or "auto"). When each switch 38, 39 is in the auto position, delivery system 20 operates normally. The on/off positions are used to separately start and stop water or colorant, respectively, for calibration purposes.

Delivery system 20 is also operatively coupled to sensor 35. Sensor 35 provides a stop signal corresponding to the absence of material on conveyer 14. This stop signal is then used to halt delivery system 20. Sensor 35 may be a microswitch with an actuation arm positioned above conveyer 14 a selected distance. This arm is configured to either open or close the microswitch when material on conveyor 14 of a selected height no longer contacts it. Opening or closing of this microswitch sends the corresponding stop signal. Other types of sensors as would occur to one skilled in the art are also contemplated.

Figure 2:
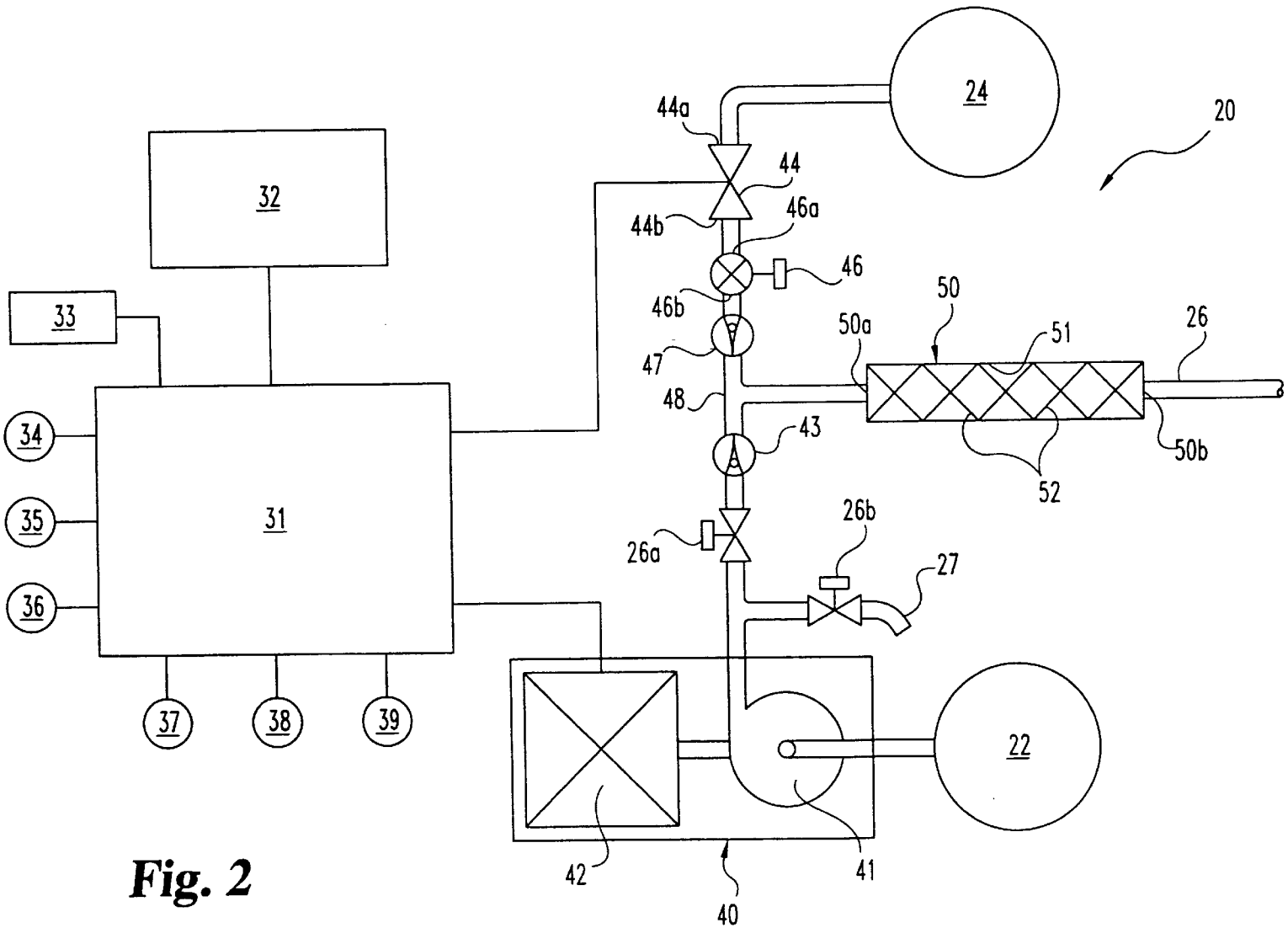
FIG. 2 is a diagrammatic view of the colorant dispensing system of the embodiment of FIG. 1.

Referring additionally to FIG. 2, further details of delivery system 20 are described. Controller 31 is operatively coupled to display 32, key pad 33, rotary control 34, sensor 35 and switches 36, 37, 38, and 39 to coordinate and supervise operation of delivery system 20. Controller 31 may be an electronic circuit comprised of one or more components. Similarly, controller 31 may be comprised of digital circuitry, analog circuitry, or both. Also, controller 31 may be programmable, an integrated state machine, or a hybrid combination thereof. However, preferably controller 31 is microprocessor with a known construction and has a control program loaded in non-volatile memory. In one embodiment a microcontroller/keyboard combination is supplied as Durant Model No. 5881-5 with part no. 5881-5-400 by Eaton Corporation of Waterloo, Wis., 53094.

Controller 31 is also coupled to pump system 40. Pump system 40 includes positive cavity control pump 41 coupled to source 22 and driven by motor 42. Controller 31 provides a delivery signal to motor 41 corresponding to a selected rate of delivery of concentrated colorant input to controller 31 with rotary control 34. In one embodiment, controller 31 responds to a stop signal from sensor 35 to generate a delivery signal which shuts down pump system 40. This delivery signal may alternatively be characterized as a "shut down" signal.

The colorant output by pump 41 encounters valves, 26*a*, 26*b*. Under usual operating conditions, valve 26*a* is open and valve 26*b* is closed so that colorant flows through check valve 43. Check valve 43 generally maintains "one way" flow of colorant away from pump 41. Colorant from check valve 43 empties into joining conduit 48. During calibration of pump system 40, valve 26*a* is closed, and valve 26*b* is open so that colorant flows through calibration outlet 27 for collection and possible reuse. Besides pump system 40, other metering devices as would occur to one skilled in the art are also contemplated.

Controller 31 is also operatively coupled to on/off valve 44 having inlet 44*a* in fluid communication with water supply 24, and outlet 44*b* for supplying water therefrom. Valve 44 is responsive to a signal from controller 31 to correspondingly start or stop water flow from supply 24. In one embodiment, controller 31 responds to a stop signal from sensor 35 to shut down water supply 24 by closing valve 44 via a shut down signal. Valve 44 may be a conventional solenoid activated stop valve.

Outlet 44*b* of valve 44 is in fluid communication with inlet 46*a* of flow regulator 46. Flow regulator 46 has outlet 46*b* in fluid communication with check valve 47. Check valve 47 maintains water flow away from flow regulator 46 to joining conduit 48. Flow regulator 46 maintains a generally constant flow rate of water despite varying pressures at inlet 46*a* and/or outlet 46*b*. Accordingly, flow regulator 46 adjusts to maintain a generally constant pressure differential between inlet 46*a* and outlet 46*b*. Flow regulator 46 has an adjustable orifice to correspondingly select the regulated rate of flow from a given range of flow rates. In one embodiment, model no. JB11T-BDM from W. A. Kates, Co., 1450 Jarvis Avenue, Ferndale, Mich. 48220 is used for flow regulator 46 to provide a desired water flow rate selected from between 3 and 80 gallons per minute. In other embodiments, a different flow regulator may be used or a flow regulator may not be used at all.

Although water and concentrated colorant may begin mixing in joining conduit 48, static in-line liquid mixer 50 provides a substantially homogenous liquid mixture of concentrated colorant diluted by water which is not generally provided by a conduit of generally constant internal cross-section. Concentrated colorant and water enter static liquid mixer 50 through inlet 50*a* and exit through outlet 50*b*. Static liquid mixer 50 is preferably made from a transparent PVC material so that blending cavity 51 therein may be observed. Within blending cavity 51 are a number of interconnected internal baffles 52. Baffles 52 are arranged to split the stream of liquid entering through inlet 50*a* and force it to opposite outside walls of mixer 50. A vortex is created axial to the center line of mixer 50 by the arrangement of baffles 52. The vortex is sheared and the process re-occurs but with opposite rotation several times along the length of static liquid mixer 50. This clockwise/counterclockwise motion mixes the liquid to provide a substantially homogenous mixture through outlet 50*b* and into conduit 26. Notably, static liquid mixer 50 operates without moving internal parts other than the liquid being mixed. This homogenous premixed liquid enhances uniform coloring of wood chips. Cole-Parmer Instrument Company of Niles, Ill. 60714 provides a PVC static liquid mixer model no. H-04669-59 which is preferred for one embodiment of the present invention.

In other embodiments, a static mixing cavity arranged to promote mixing without internal baffles may be used. U.S. Pat. No. 4,516,524 to McClellan et al. is cited as a source of additional information concerning a dedicated static mixing cavity of this type. In still other embodiments, premixing of colorant and water prior to entry into chamber 70 is not necessary.

By controlling the rate of delivery of colorant with control 34 to static liquid mixer 50 and maintaining a generally constant flow rate of water with flow regulator 46, a desired concentration of water based colorant mixture may be selected. This concentration, and the rate of flow of the mixture to chamber 70 of mixer 60 may be matched to the rate of transport of wood chips therethrough to optimize colorant system 10 performance. As a result, the minimum amount of water necessary to provide uniform coloration for the wood chips may be determined by taking into account the absorbency of the liquid by the wood chips 12, the rate of flow of the liquid into chamber 70, and the rate of passage of wood chips 12 through mixer 60. Notably, the rate of liquid flow can be adjusted with flow regulator 46 and with rotary control 34, and the ratio of water to colorant can likewise be adjusted to assure a concentration which will provide uniform coloration. By optimizing these amounts, the amount of liquid runoff can be minimized and this optimal performance can be reliably reproduced. Also, an adjustable flow rate and colorant delivery rate permits re-optimization of the process when various parameters change; including, but not limited to, a different colorant type, different wood chip delivery rate, or different type of wood chips.

Besides optimizing colorant mixture delivery to mixer 60, in other embodiments controller 31 may also be used for a variety of record keeping functions, such as maintaining a record of the amount of colorant dispensed over a given period of time. The amount dispensed may be displayed or otherwise accessed by an operator using keypad 33. Controller 31 may be configured to provide an operator preferred parameters for flow regulator 46 and metering of colorant with pump system 40 via display 32 and keypad 33. Also, it may be configured to assist the operator with adjustments relating to different wood chip types, sizes, or delivery rates. In this embodiment, the speed of conveyer 14 may also be sensed with controller 31 to ascertain optimum liquid mixture parameters of delivery system 20. Also, controller 31 may control speed of conveyer 14 or 18, or otherwise be coupled to mixer 60 to control various operational aspects thereof. In one alternative embodiment, control panel 30, controller 31, display 32, control 34, and switches 36, 37, 38, 39 are embodied in a ruggedized personal computer customized with appropriate hardware and software to controllably interface with the other components of delivery system 20 and including a conventional video display and keyboard.

In an alternative embodiment, operator control via controller 31 is provided over the rate of water flow to the mixture instead of colorant. In this embodiment, colorant concentration is regulated by adjusting the amount of water with controller 31, and the colorant flow is kept generally constant. In other embodiments, both water supply 24 and source 22 are operatively coupled to controller 31 to provide dynamic adjustment over the relative flow rate and amount of from each. In still other embodiments, more than two sources of liquid components may be operatively coupled to controller 31 to provide a desired liquid mixture.

Delivery system 30 may also be used to control delivery of various other mixtures of liquid agents or mixing components. Also, besides wood chips, other solid pieces may be treated with a given liquid mixture from delivery system 20 in mixer 60. For example, a high gloss transparent coating on certain types of landscaping rocks or gravel may also be provided with system 10. Preferably, this clear coat is provided by a mixture of water and an organic-based polymer component. Similarly, other solid pieces and liquid mixtures containing various components may be used with system 10 as would occur to one skilled in the art.

Referring next to FIG. 1 and FIGS. 3–5, additional details concerning mixer 60 are next described. Mixer 60 includes enclosure 61 defining chamber 70. Enclosure 61 is elongated and has end 61*a* opposing end 61*b* along its length. Enclosure 61 has top 62 opposing base 64. Opposing sides 66 and 68 join top 62 and base 64. Top 62 defines inlet 72 and grated observation window 76. Preferably, top 62 is provided by panels which may be removed to gain access to chamber 70 for maintenance purposes. Base 64 defines discharge outlet 74.

Figure 3:
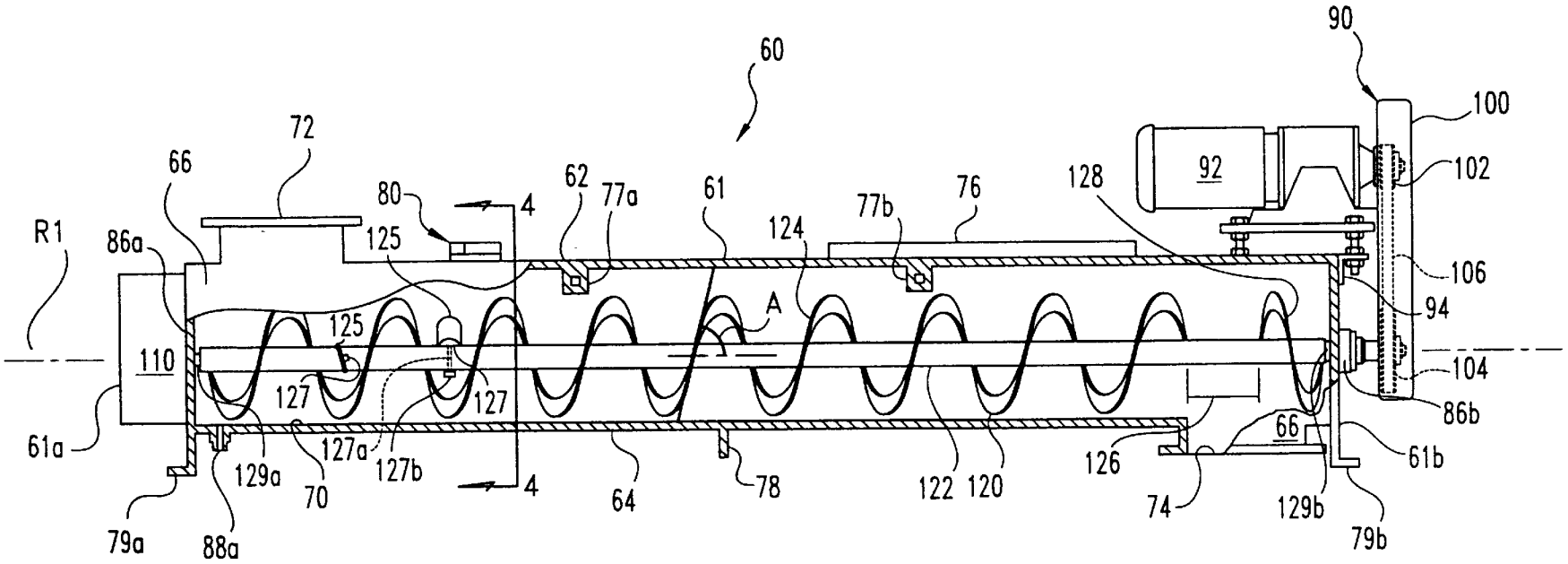
FIG. 3 is a partial cut-away side view of the mixer of the embodiment of FIG. 1.

In FIG. 3 specifically, internal transverse support members 77*a*, 77*b* are shown in cross-section. Members 77*a*, 77*b* include a square cross-section and are preferably manufactured from carbon steel. Also, support flange 78 is illustrated between ends 61*a* and 61*b* of enclosure 61. Adjacent end 61*a*, 62*b* is a right angle bearing flange 79*a*, 79*b* which supports mixer 60.

Figure 4:
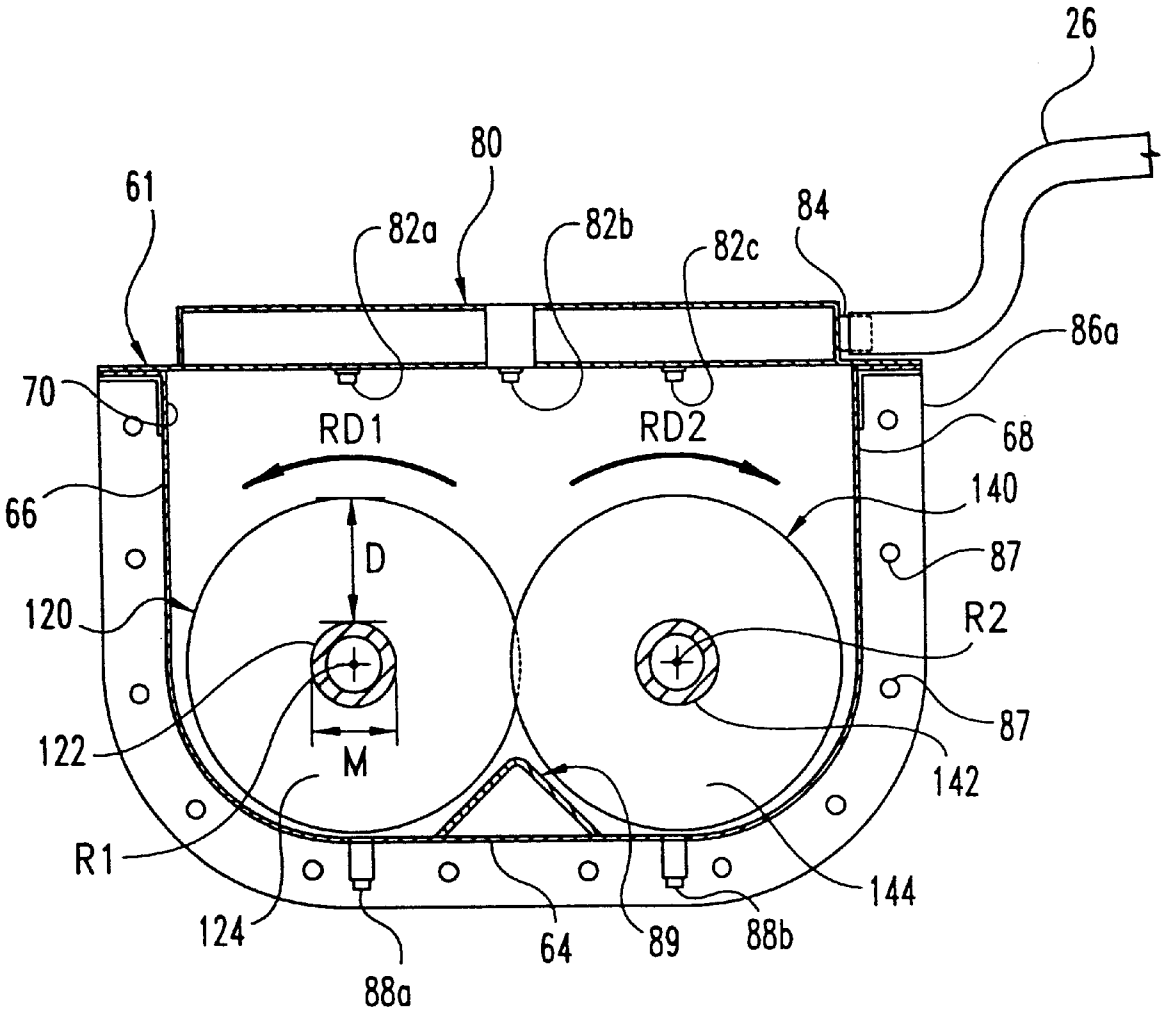
FIG. 4 is a side sectional view of the mixer shown in FIG. 3.

FIGS. 1,3 and 4 illustrate a spray manifold 80. Spray manifold 80 is in fluid communication with spray nozzles 82*a*, 82*b*, 82*c* (collectively designated nozzles 82). In other embodiments, more or less nozzles may be used. Nozzles 82 are in fluid communication with chamber 70. Manifold 80 has intake 84 configured to receive liquid through conduit 26 for distribution within manifold 80 to nozzles 82. Excess liquid within chamber 70 may be drained through drain plugs 88*a*, 88*b*, as particularly illustrated in FIGS. 3 and 4.

Referring specifically to FIG. 4, a cross-section of chamber 70 is shown. Also, protruding end flange 86*a* is illustrated with a number of attachment sights 87 along its periphery. End flange 86*a* is joined to bearing flange 79*a* using conventional methods. A similar structure at end 61*b* is formed with end flange 86*b* and bearing flange 79*b*. At the bottom of chamber 70 is a triangular partition 89. Preferably, enclosure 61 and manifold 80 are manufactured from a metallic material, such as carbon steel; however, other materials as occur to one skilled in the art are also contemplated.

Figure 5:
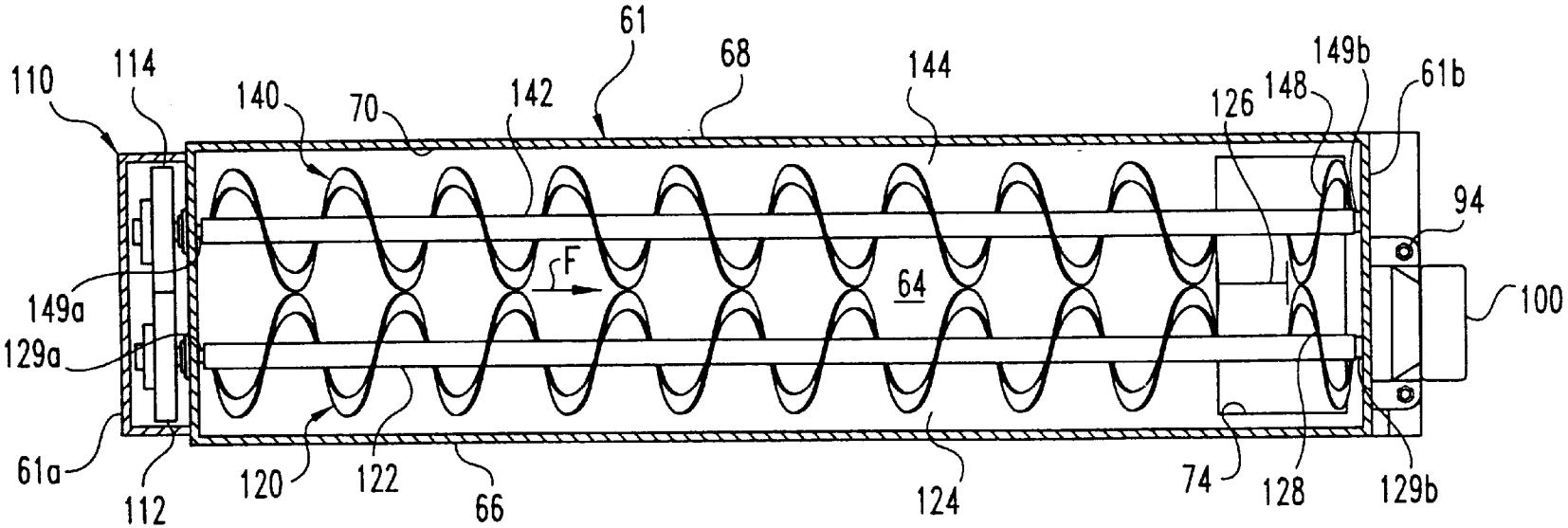
FIG. 5 is a top sectional view of the mixer shown in FIG. 3.

FIGS. 1,3, and 5 depict various features of drive mechanism 90. Drive mechanism 90 includes motor 92 mounted to enclosure 61 by support 94. Also drive mechanism 90 includes drive box 100 and gear box 110. Preferably, motor 92 is electrically powered, but other types of motors may also be employed, such as a gasoline-fueled internal combustion engine. A shaft from motor 92 extends into drive box 100 and is connected to sprocket 102 therein. Sprocket 102 is operatively coupled to sprocket 104 by drive chain 106.

Sprocket 104 is attached to auger 120 by coupling shaft 129*b* at the end of auger 120 closest to end 61*b* of enclosure 61. An opposing end of auger 120 is attached to coupling shaft 129*a* which extends into gear box 110. Within gear box 110, gear wheel 112 is coupled to coupling shaft 129*a* and intermeshes with gear wheel 114 coupled to coupling shaft 149*a*. Shaft 149*a* is coupled to auger 140 at the end of auger 140 closest to end 61*a* of enclosure 61. At the opposing end of auger 140, coupling shaft 149*b* is coupled thereto. Coupling shafts 129*a*, 149*a* are rigidly attached to shafts 122, 142, respectively, and are journaled to enclosure 61 at end 61*a* by appropriate bearings. Coupling shafts 129*b*, 149*b* are rigidly attached to shafts 122, 142 and are journaled to enclosure 61 at end 61*b* by appropriate bearings.

Referring specifically to FIGS. 3–5, auger 120, 140 are further described. Auger 120 includes a shaft 122 generally oriented along the length of enclosure 61. Attached to auger 120 is helical or spiral flight 124. Flight 124 is configured to turn about shaft 122 in a counterclockwise direction as it advances from end 61*a* toward end 61*b*. Preferably, flight 124 makes at least three revolutions about shaft 122. More preferably, flight 124 makes at least five revolutions about shaft 122. Most preferably, flight 124 makes at least nine revolutions about shaft 122.

Preferably, the pitch angle of flight 124 is at least 45°. More preferably, the pitch angle of flight 124 is in the range of 65° to 80°. Most preferably, the pitch angle of flight 124 is about 75°. As used herein, "pitch angle" means the angle formed between a tangent to an edge of the helical flight and the rotational axis of the flight. FIG. 3 illustrates a pitch angle of flight 124 as angle A. In one embodiment, the pitch angle of flight 124 varies, with a portion closest to end 61*a* having a different pitch angle than the rest of flight 124. In other embodiments, the pitch angle varies in a different fashion or is generally constant.

Referring specifically to FIG. 3, auger 120 includes mixing paddles 125 interposed along flight 124. Each mixing paddle 125 is attached to shaft 122 by fastener 127. Each fastener 127 has bolt 127*a* extending through shaft 122 and secured thereto by nut 127*b*. By loosening nut 127*b*, the pitch of mixing paddle 125 relative to flight 124 may be adjusted. Nut 127*b* is then re-tightened to secure the newly selected paddle pitch. Preferably, mixing paddles 125 do not extend as far from shaft 122 as flight 124. It is also preferred that auger 140 include mixing paddles distributed along shaft 142 which are interposed with flight 144 (not shown).

In one embodiment, about twelve mixing paddles 125 are distributed along shaft 122, being spaced along the segment of axis R1 corresponding to flight 124 at approximately equal intervals. From one to the next, mixing paddles 125 of this embodiment are positioned about axis R1 approximately 75 degrees apart. In addition, each mixing paddle has a portion extending from shaft 122 that has a generally planar sector shape. This sector shape sweeps about a 40 degree angle between radii extending from axis R1. Preferably, auger 140 is similarly configured for this embodiment.

Referring again to FIGS. 3–5, auger 120 also has a reverse spiral flight 128 spaced apart from flight 124 by gap 126 along shaft 122. Preferably, flight 128 turns around axis R1 at least 180 degrees. More preferably, flight 128 turns about axis R1 at least 330 degrees. Most preferably, flight 128 turns about axis R1 approximately 360 degrees or makes about one revolution around shaft 122 (including axis R1) between flight 124 and end 61*b*. Flight 128 advances in a direction from end 61*a* to 61*b* with a clockwise spiral rotation. Thus, the rotational direction of flight 128 is opposite the rotational direction of flight 124.

Generally, shaft 122 along gap 126 is flightless. The length of gap 126 along shaft 122 is preferably about the length of flight 124 along shaft 122 corresponding to one revolution about shaft 122. Gap 126 and flight 128 both partially overlap or overhang outlet 74 so that at least a portion of flight 128 is positioned over outlet 74.

Auger 140 is configured similar to auger 128 except the rotational orientation of the flighting is reversed. Specifically, helical flight 144 of auger 140 turns about shaft 142 in a clockwise direction as it advances from end 61*a* to end 61*b*. Flight 148 turns about shaft 142 in a counterclockwise direction as it advances in a direction from end 61*a* toward end 61*b*. Augers 120 and 140 preferably intermesh a slight amount as most clearly depicted in FIG. 4. This intermeshing is accomplished by slightly offsetting the maximum extension point of the flights relative to each other.

FIG. 4 illustrates additional characteristics of flight 124, 144. Shaft 122 has a maximum cross-sectional dimension (M) perpendicular to the plane of view of FIG. 4, and flight 124 has a distance D extending from shaft 122 along this plane. Preferably, the extension ratio (ER), of D to M is greater than 1; where ER=D÷M. More preferably, ER is at least 1.5, and most preferably ER is at least 2.0. The quantity M is determined as the maximum cross-sectional dimension of the shaft for its given shape along a cross-sectional plane perpendicular to its rotational axis. Similarly, D is determined as the distance the flight extends from the shaft along an axis perpendicular to the rotational axis of the shaft. Preferably, shafts 122, 144 each have a generally right cylindrical shape, presenting an approximate circular cross-section perpendicular to rotational axes R1, R2; and flights 124, 128, 144, 148 present a generally circular cross-section along a plane perpendicular to the rotational axes R1, R2 of the shafts 122, 142, respectively.

Generally referring to FIGS. 1–5, selected operational features of mixer 60 are next discussed. Chips 12 enter inlet 72 of enclosure 61 via conveyer 14. When activated, motor 92 turns sprocket 102 which rotates sprocket 104 via chain 106. Rotation of sprocket 104 turns auger 120 about rotational axis R1 in the direction RD1, driving auger 120 in a counterclockwise or "left hand" direction. Rotational axes R1, R2 are shown in FIG. 4 as cross-hair points generally concentric with the cross-section of shafts 122, 142, respectively. Notably, these axes are generally parallel to each other and are parallel to the longitudinal axis of augers 120, 140, and enclosure 61.

The rotation of auger 120 turns gear wheel 112 contained in gear box 110. Gear wheel 112 rotates gear wheel 114 in response in the opposite direction. Correspondingly, auger 140 rotates along with gear wheel 114 in a clockwise or "right hand" direction indicated by arrow RD2.

Rotation of flights 124, 144 of auger 120, 140 about axes R1, R2 provides an "archimedes screw" type of conveyer which transports wood chips 12 entering inlet 72 along the direction indicated by arrow F, from end 61*a* toward end 61*b*. At the same time that flights 124, 144 move material along arrow F, flights 124, 144 also tumble and intermix the solid pieces with a liquid colorant mixture sprayed into chamber 70 via nozzles 82. The liquid mixture is supplied by dispensing system 20 to manifold 80. The mixing of the liquid and solid pieces continues as it travels past manifold 80 and by window 76 along arrow F. Mixing paddles 125 assist intermixing by agitating the mixture of solid pieces and liquid. Preferably, mixing paddles 125 are pitched to oppose the flow of material along arrow F; and thereby enhance mixing. By adjusting the pitch of mixing paddles 125 relative to flight 124, the average dwell time in chamber 70 of a given material may be changed. This feature further assists in controlling absorption of the liquid mixture by the wood chips to minimize run-off.

As gap 126 is encountered by material moving through chamber 70, processed wood chips 16 begin to exit through outlet 74 to be carried away by conveyer 18 in a direction indicated by arrow O.

Unfortunately, the wet mass of material at gap 126 has a tendency to stick together—despite gravity urging it to fall through outlet 74. As a result, material may occasionally bridge gap 126 and encounter either or both of flights 128 and 148. Because flights 128, 148 oppose the rotational orientation of flights 124, 144, respectively; flights 128, 148 both tend to move material opposite the direction of arrow F—that is in a direction away from end 61*b*. The opposing configurations of flights 124, 144 with respect to flights 128, 148 tend to break up a mass of material bridging gap 126 to thereby facilitate discharge through outlet 74. Consequently, the auger configuration of mixer 60 tends to reduce the incidence of material packing in outlet 74 and so reduces the number of mixing interruptions due to jamming or clogging.

Mixer 60 may be used with a variety of liquid mixture types for coating or adhering a desired substance to wood chips. Likewise, various solid pieces other than wood chips may be processed in this manner. Preferably, mixer 60 is used so that the direction of the flow along arrow F is generally horizontal. However, in other embodiments, mixer 60 may be inclined in varying amounts as would occur to one skilled in the art.

Figure 6:
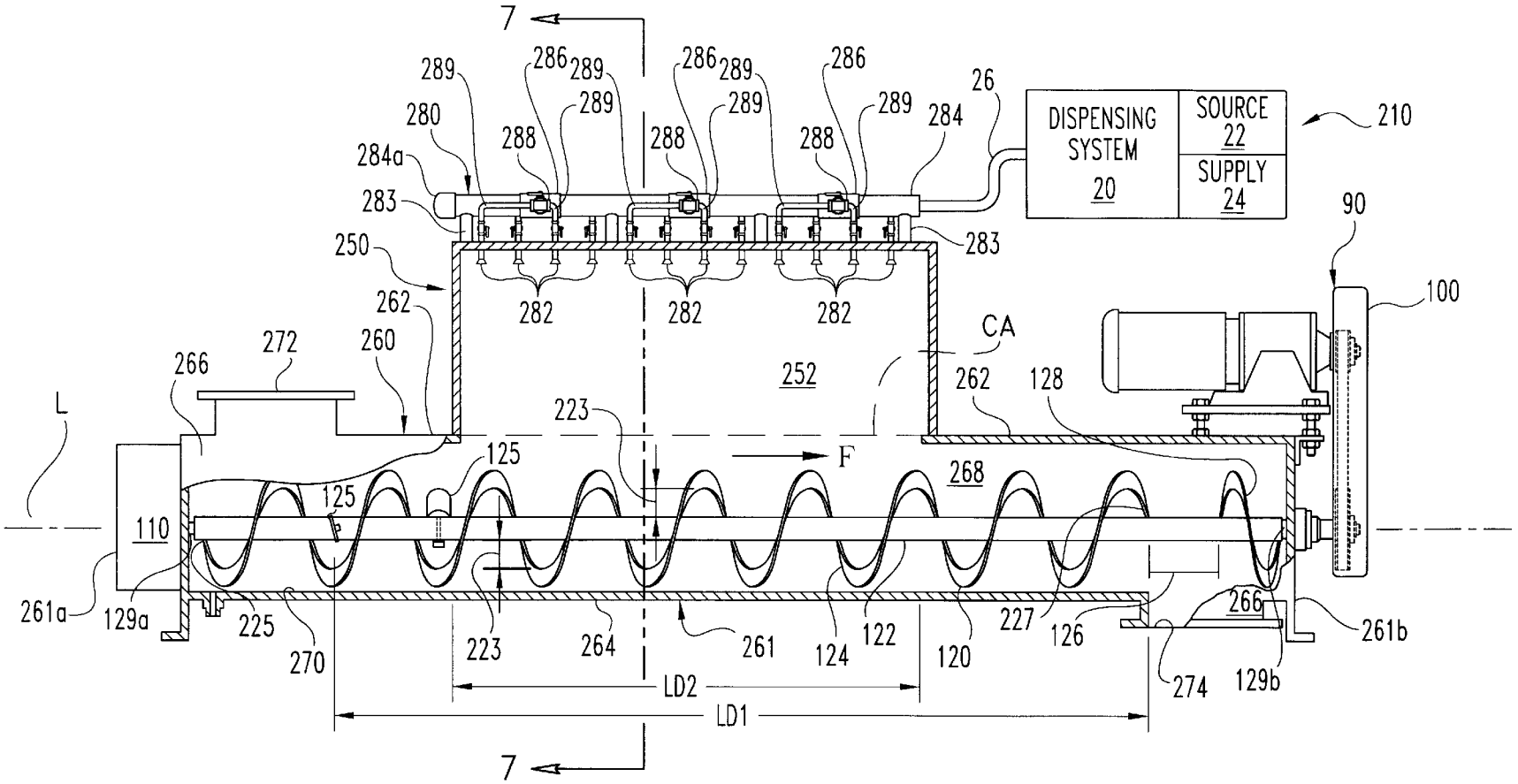
FIG. 6 is a partial, cut-away side view of a mixing system of another embodiment of the present invention.
Figure 7:
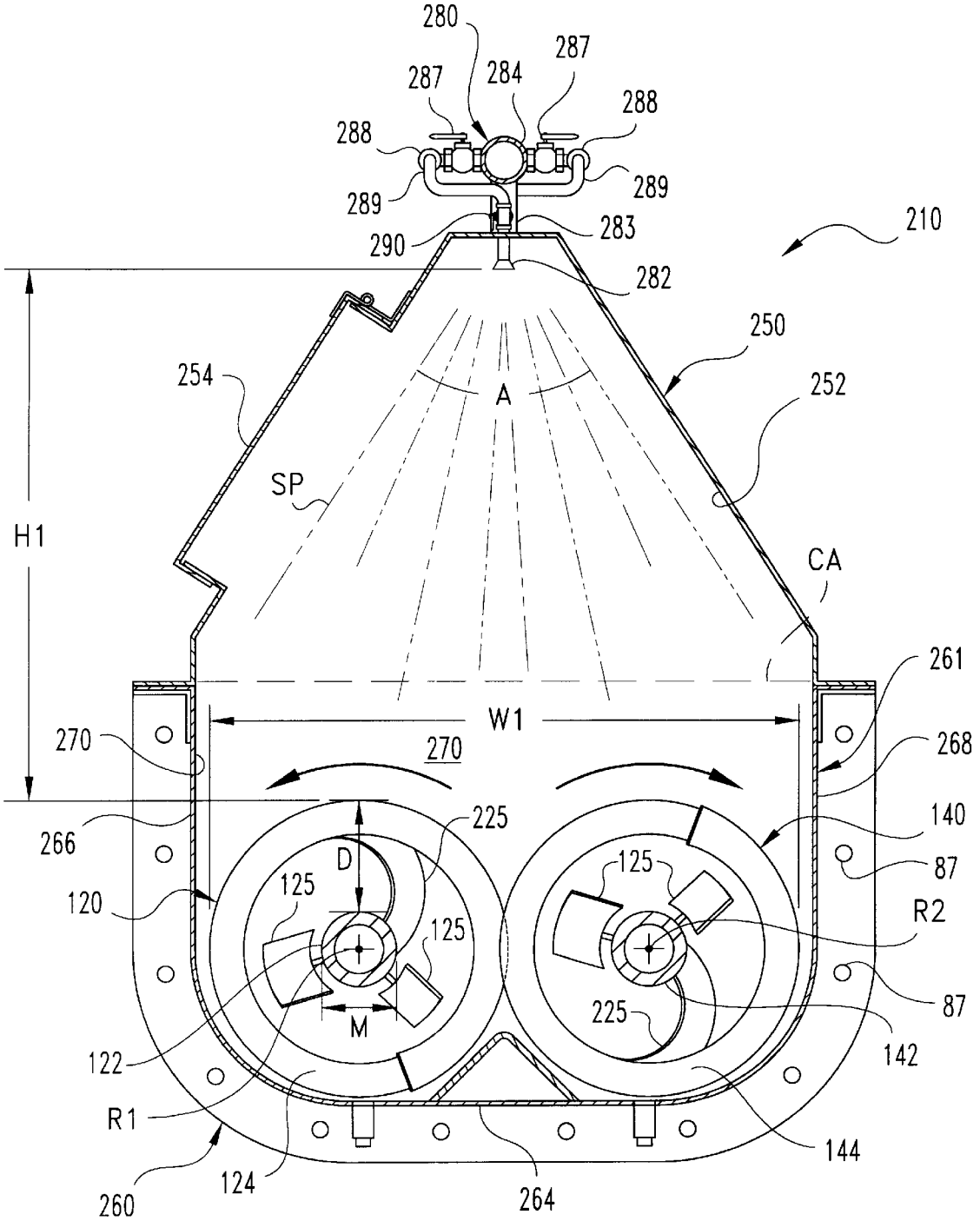
FIG. 7 is a partial sectional view of the mixer taken along section line 7—7 of FIG. 6.

FIGS. 6 and 7 depict mixing system 210 of another embodiment of the present invention; where certain reference numerals are the same as those used in connection with system 10 and are intended to represent like features. System 210 includes dispensing system 20, spray hood 250, and mixer 260. Dispensing system 20 delivers a liquid mixture to spray hood 50 via conduit 26 that is dispersed within chamber 252 of spray hood 250 and then contacts solid pieces passing through mixer 260. As previously described, system 20 is controller-based and regulates the blending of a mixture of an agent from source 22 with water from supply 24. Likewise, as described in connection with mixing system 10, the regulation and control processes implemented with dispensing system 20 also apply to system 210.

Mixer 260 is coupled to spray hood 250 and includes a mixing trough 261 extending along its longitudinal axis L with opposing ends 261*a*, 261*b*. Trough 261 is partially covered by top 262. Top 262 is opposite base 264. Trough 261 is bounded by opposing side walls 266, 268 and defines a mixing passage 270. Trough 261 has inlet 272 defined through top 262 adjacent end 261*a* and outlet 274 defined through base 264 adjacent end 261*b*. Inlet 272 and outlet 274 intersect passage 270. Inlet 272 and outlet 274 are separated from each other along axis L by distance LD1.

Disposed within passage 270 are augers 120, 140. Augers 120, 140 extend from inlet 272 to outlet 274 and are turned by drive mechanism 90 via drive box 100 and gear box 110 as described in connection with mixer 60 of system 10. Augers 120, 140 have shafts 122, 142 and helical flights 124, 144, respectively, as previously described. As shown in FIG. 6, a space 223 is defined between flight 124 and shaft 122 except at the ends 225, 227 which are connected to shaft 122. Space 223 corresponds to a cross-section along axis L having a generally circular outer and inner contour bounded by flight 124 and shaft 122, respectively. A like space is preferably defined between flight 144 and shaft 142 of auger 140. To accommodate mixing, it is also preferred that space 223 extend between shaft 122 and flight 124 for a distance corresponding to at least three revolutions of flight 124 about shaft 122. More preferably, this distance corresponds to at least six revolutions of flight 124 about shaft 122. Most preferably, flight 124 is separated from shaft 122 and does not make contact therewith, defining space 223 therebetween, except where connected at ends 225 and 227.

Further, FIG. 6 depicts flight 128 overlapping outlet 274 with an opposite rotational direction relative to flight 124.

Flight 124 is separated from flight 128 by a flightless gap 126 along shaft 122. Preferably, auger 140 has a second flight sized and positioned like flight 128 with a rotational direction opposite flight 144 as described in connection with system 10. The second flights 128, 148 for each auger 120, 140, respectively, have been found to reduce clogging at outlet 274. Also as described in connection with system 10, augers 120, 140 preferably include adjustable mixing paddles 125. Paddles 125 may be utilized to adjust dwell time of products being mixed in trough 261.

Spray hood 250 defines chamber 252 and has a hinged access door 254 to facilitate maintenance as is best depicted in FIG. 7. Manifold 280 is connected to the top of hood 250 and includes a number of spray nozzles 282 for delivering the liquid from system 20 to chamber 252 via supply conduit 284. Conduit 284 receives and distributes the liquid from system 20 via conduit 26 coupled thereto. Several brackets 283 support conduit 284 along hood 250 above nozzles 282. Conduit 284 terminates in end cap 284*a*.

Referring to FIG. 7, it is preferred that each nozzle 282 have a spray pattern SP that subtends an angle A. Preferably, angle A is at least 60 degrees. More preferably, angle A is at least 80 degrees. One preferred nozzle 282 is model no. USS8060 provided by Spraying Systems Company having a business address of P.O. Box 7900, Wheaton, Ill. 60189-7900. This model is of the VEEJET line and sprays about 6 gallons per minute when supplied liquid at a pressure of about 40 lbs. per square inch (psi). Preferably, at least 8 nozzles are utilized. More preferably, at least 12 nozzles are utilized as depicted in FIG. 6.

Figure 8:
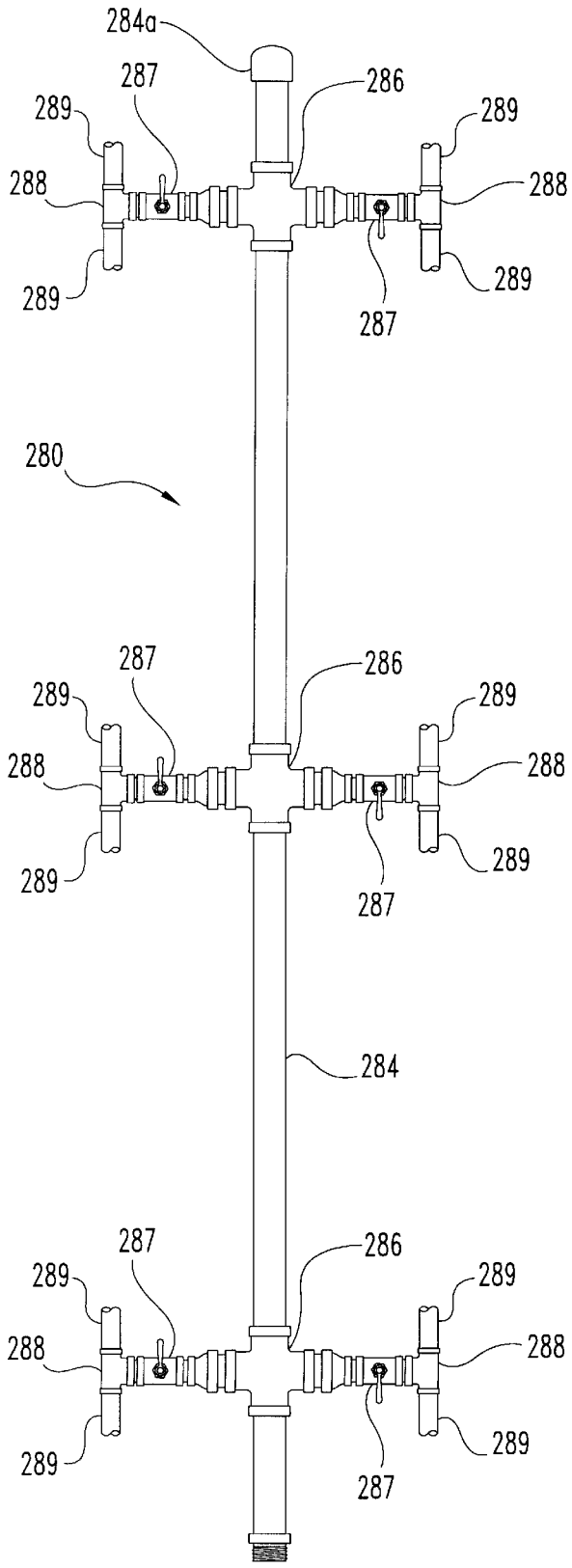
FIG. 8 is a partial, top view of the manifold shown in FIGS. 6 and 7.

Referring additionally to FIG. 8, conduit 284 of manifold 280 includes a four-way conduit junction 286 for every four nozzles 282. Each junction 286 is in fluid communication with two valves 287 on opposite sides thereof. Each valve 287 is in fluid communication with a "T" junction coupling 288. A hose 289 is coupled to each opposite end of coupling 288 to a corresponding valve 290 in fluid communication with one of nozzles 282. Thus, for the configuration depicted in FIG. 6, three junctions 286, six valves 287, and six "T" junction couplings 288 are utilized. Further, there are twelve hoses 289 and twelve valves 290 each corresponding to one of nozzles 282.

In one preferred embodiment of hood 250, chamber 252 is defined by a metal enclosure and door 254 is similarly formed from metal. For this embodiment, conduit 284 of manifold 280 is preferably formed from a two-inch diameter PVC pipe and junctions 286 are each provided as a four-way two-inch PVC connector. Valves 287 and 290 are of a half-inch variety and may be adjusted by hand. For this embodiment, transition members/reducers are used between values 287 and corresponding junctions 286. Couplings 288 are likewise formed from PVC and hoses 289 are of a standard reinforced rubber type for this embodiment.

At the intersection of chamber 252 with passage 270 an area for contacting pieces in trough 261 is defined. This area is designated as contact area CA in FIGS. 6 and 7. Area CA has a length LD2 along the distance LD1 as shown in FIG. 6. Preferably, distance LD2 is at least about half of distance LD1. More preferably, distance LD2 is at least two-thirds of distance LD1. Augers 120, 140 occupy a maximum width across passage 270 below spray hood 250 represented as width W1 in FIG. 7. W1 is the maximum transverse distance across axis L collectively occupied by augers 120, 140. Area CA preferably has a width that is at least one-half the width W1. More preferably, the width of area CA is at least about three-fourths of the width W1. Most preferably, the width of area CA is substantially all of width W1 as shown FIG. 7.

In correspondence with area CA, nozzles 282 are spaced at intervals along axis L to provide a collective spray pattern along distance LD2. Preferably, the spray pattern has a length of at least about one-half of distance LD1 and a width at least about one-half of width W1. More preferably, the length of the spray pattern along axis L is at least about two-thirds the distance LD1 and a maximum width of at least about three-fourths of width W1. Most preferably, the spray pattern has a length generally the same as distance LD2 that is greater than or equal to about two-thirds of the distance LD1 and a width that is substantially all of the width W1 at a number of intervals along the distance LD2. As depicted in FIG. 7, it is also preferred that nozzles 282 be separated from augers 120, 140 by a height of at least one-half W1 to facilitate dispersal of the liquid from system 20 in chamber 252 before contacting solid pieces being carried through passage 270.

In operation, mixer 260 is configured to accept solid pieces through inlet 272 which are then advanced along passage 270 towards outlet 274 in the direction indicated by arrow F by turning augers 120, 140 with drive mechanism 90. As the pieces are advanced with augers 120, 140, they are tumbled and intermixed facilitating coating, coloring, or another mixing process with a liquid introduced through spray hood 250. The pieces passing through mixer 260 may be, for example, wood chips of a suitable size and consistency for use as a mulch and the liquid delivered with system 20 may be a mixture of a liquid colorant and water to impart a desired color to the wood chips.

Collectively, the valves 287, 290 may be adjusted to provide a desired spray pattern within chamber 252 with nozzles 282. For example, each valve 290 may be adjusted to selectively reduce or shut-off the spray from the nozzle 282 coupled thereto. Valves 287 may each be used to shut-off or adjust flow to each respective pair of nozzles 282 coupled thereto via a corresponding coupling 288, pair of hoses 289, and pair of valves 290. In one mode of operation, valves 287 are used to make coarse adjustments and valves 290 are used to make fine adjustments. By selectively adjusting valves 287, 290 and parameters of system 20 previously described, greater control over the mixing process may be obtained. In one alternative embodiment, these nozzles are electronically controlled by a controller to establish various predetermined patterns (not shown).

Moreover, it has been found that the expansive spray pattern of system 210 facilitates a reduction in water usage needed in order to color wood chips to provide a suitable mulch with a generally uniform color. It is believed this reduction in water consumption results because the amount of chip surface area contacted by the color-imparting spray is greater than with existing systems, so that the amount of color-imparting liquid that needs to freely flow in trough 261 to properly color the wood chips is comparatively less. However, it should be understood that it is not intended that the claimed invention be limited to any stated mechanism or theory.

Several experiments were performed using equipment arranged as described for system 210. A number of different types of wood based products were colored in a manner suitable to serve as a mulch. The tested products may be as much as 40% by volume saw dust with the balance being wood pieces having a maximum dimension in a range of about ½ inch to about 2 inches. Also, the tested product has a widely varying moisture content. Coloration was performed by contacting the wood product with a liquid coloring mixture obtained by mixing a concentrated liquid colorant with water. Water consumption of 10 gallons or less per cubic yard of wood product colored was observed under these conditions. This result indicates at least a 20% reduction in water consumption compared to other coloration systems.

In one preferred embodiment, system 210 is used to color wood chips provided in a consistency suitable for application as a mulch; however, in another embodiment, a scent is additionally supplied in order to simulate a known type of mulch such as eucalyptus, cedar, or pine. For this embodiment, scent may be dispensed in a liquid form from a separate system comparable to system 20 and may be introduced into chamber 252 through one or more nozzles 282 instead of the colorant mixture. Alternatively, the scent may be homogeneously mixed with colorant and water before being dispensed to hood 250, or a single vessel containing concentrated liquid colorant and scent that has been premixed may be mixed with water in dispensing system 20 and subsequently supplied to hood 250.

In still other embodiments, system 210 may be used with a variety of liquid mixture types for coating or adhering a desired substance to solid pieces. Indeed, solid pieces other than wood chips may be processed in this manner, such as rocks, cardboard, synthetic resin pieces, and the like. Moreover, while it is preferred that mixer 260 generally be maintained in a horizontal position, in other embodiments, trough 261 may be inclined in varying amounts as would occur to one skilled in the art. In addition, it is envisioned that various components and operations described in connection with systems 10 and 210 may be interchanged, deleted, substituted, combined, modified, divided or reordered as would occur to one skilled in the art without departing from the spirit of the invention.

All publications and patent applications cited in this specification are herein incorporated by reference as if each individual publication or patent application were specifically and individually indicated to be incorporated by reference, including, but not limited to, commonly owned U.S. patent application Ser. No. 08/650,871, filed May 20, 1996.

While the invention has been illustrated and described in detail in the drawings and foregoing description, the same is to be considered as illustrative and not restrictive in character, it being understood that only the preferred embodiments have been shown and described and that all changes, modifications, and equivalents that come within the spirit of the invention as defined by the following claims are desired to be protected.

What is claimed is:

1. A method of mixing, comprising:

moving a number of wood chips within a mixing chamber;

blending water and colorant in a static liquid mixer during performance of said moving to produce a generally homogeneous liquid colorant mixture for supply to the chamber, the mixer including a cavity containing one or more internal baffles oriented to mix the water and colorant, said blending including metering colorant to the mixture with a variable rate pump responsive to a controller while maintaining a generally constant flow rate of the water to the mixture with a flow rate regulator;

determining a coloring property of the wood chips;

adjusting concentration of the colorant in the mixture from a first nonzero amount to a second nonzero amount in accordance with the coloring property of the wood chips, said adjusting including changing delivery rate of the colorant to the mixture with the controller;

coloring at least a portion of the wood chips in the chamber by providing the mixture to the chamber during said moving; and discharging the wood chips from the chamber.

2. The method of claim 1, further comprising displaying a visual indicator corresponding to colorant delivery rate provided to the cavity for said mixing.

3. The method of claim 1, further comprising maintaining a record of an amount of colorant dispensed with the controller.

4. The method of claim 1, wherein said moving includes rotating an auger disposed in the chamber, the auger having a helical flight connect to a shaft, the flight making at least three revolutions about the shaft without contacting the shaft to define a space therebetween.

5. The method of claim 1, wherein a spray hood with a number of nozzles is positioned above the chamber to provide the mixture, and the nozzles define a spray pattern along at least about two thirds of a distance separating the outlet and the inlet.

6. The method of claim 1, wherein said moving includes rotating an auger disposed in the chamber, the auger having a first helical flight and a second helical flight, the second flight overlaps the outlet and has a rotational orientation opposite the first flight.

7. A method of mixing, comprising:

moving a number of wood chips through a generally horizontal, elongate passage of a mixer from a top inlet adjacent a first end of the mixer to a bottom outlet adjacent a second end of the mixer, said moving being performed by turning a pair of augers disposed within the passage, the inlet and the outlet being spaced apart from each other along a longitudinal axis of the mixer;

mixing a liquid colorant and water to provide a liquid coloring mixture during said moving, said mixing being regulated with a controller;

providing the mixture to a spray hood during said moving to impart color to the wood chips, the spray hood defining a chamber projecting above the passage and having a plurality of nozzles delivering the mixture to the chamber under pressure, the chamber intersecting the passage to define an area for contacting the wood chips with the mixture, the area being positioned generally opposite the nozzles to extend along the longitudinal axis of the mixer at least about two thirds of a distance between the inlet and the outlet and transversely span across at least about three fourths of a maximum width spanned by the augers across the passage; and discharging the wood chips through the outlet.

8. The method of claim 7, further comprising metering water to the mixture at a rate of no more than about 10 gallons per cubic yard of the wood chips colored by the mixture.

9. The method of claim 7, further comprising maintaining a record of an amount of the liquid colorant dispensed with the controller.

10. The method of claim 7, wherein said mixing includes:

metering flow of the water into the mixture with a flow rate regulator;

adjusting concentration of the liquid colorant from a first nonzero amount to a second nonzero amount with a pump responsive to the controller to accommodate a change in a coloring property of the wood chips; and blending the liquid colorant and the water in a static in-line mixer defining a cavity containing one or more internal baffles oriented to blend the colorant and water therein.

11. The method of claim 7, further comprising spraying transversely across the area with each of the nozzles, the nozzles being spaced apart from one another along the distance.

12. The method of claim 11, wherein the nozzles are separated from the area by a height greater than or equal to one half the width to promote dispersal of the mixture before contacting the wood chips in the trough.

13. The method of claim 11, wherein the at least a portion of the passage between the hood and the outlet is covered.

14. The method of claim 7, wherein the pair of augers each have a first helical flight and a second helical flight revolving about a shaft, the first flight extends along the shaft for at least three revolutions without contacting the shaft to define a space therebetween, and the second flight overlaps the outlet with a rotational orientation opposite the first flight.

15. A method of mixing, comprising:

moving a number of wood chips through a generally horizontal, elongate passage of a mixer, the passage extending from an inlet to an outlet, said moving being performed by a pair of augers disposed within the passage, the inlet and the outlet being separated by a distance along a longitudinal axis of the chamber;

mixing a liquid colorant and water to provide a liquid coloring mixture during said moving, said mixing being regulated with a controller;

spraying the mixture into the chamber under pressure with a number of nozzles positioned above the auger to impart color to the wood chips during said moving, the nozzles defining a spray pattern extending along at least about two thirds of the distance separating the inlet and the outlet, the pattern transversely spanning across at least about three fourths of a maximum width spanned by the augers across the passage; and discharging the wood chips through the outlet.

16. The method of claim 15, wherein the spray pattern generally spans across substantially all the maximum width.

17. The method of claim 15, further comprising applying another liquid to the wood chips during said moving to impart a scent of a predetermined type of wood.

18. The method of claim 15, further comprising:

metering colorant supplied to the mixture with a variable rate pump responsive to the controller; and maintaining a generally constant flow rate of water to the mixture with a flow rate regulator.

19. The method of claim 15 wherein the spray pattern spans across at least about three fourths of the maximum width at a number of intervals spaced along the distance separating the inlet and the outlet.

20. The method of claim 15, wherein said mixing includes metering water for the mixture at a rate of no more than about 10 gallons per cubic yard of wood chips colored by the mixture.

21. The method of claim 15, wherein the pair of augers each have a first helical flight and a second helical flight revolving about a shaft, the first flight extends along the shaft for at least three revolutions without contacting the shaft, and the second flight overlaps the outlet and has a rotational orientation opposite the first flight.

* * * * *